US005179817A

United States Patent [19]

Barnes et al.

[11] Patent Number: 5,179,817

[45] Date of Patent: Jan. 19, 1993

[54] METHOD WHERE EXPOSED FOIL ON TOP OF CIGARETTE BUNDLE IS FLAT WITH NO APPARENT FOLDS

[75] Inventors: John D. Barnes, Newport News; Howard H. Fishburne, Charlotte; Xuan M. Pham; Linwood L. Pitt, Jr., both of Richmond, all of Va.

[73] Assignee: Philip Morris Incorporated, New York, N.Y.

[21] Appl. No.: 567,810

[22] Filed: Aug. 15, 1990

[51] Int. Cl.[5] ..... B65B 11/08; B65B 19/22

[52] U.S. Cl. ..... 53/148; 53/230

[58] Field of Search ..... 53/444, 462, 466, 148, 53/228, 230, 234

[56] References Cited

U.S. PATENT DOCUMENTS

| | | | |
|---|---|---|---|
| 2,107,482 | 2/1938 | Kemp | 53/230 |
| 2,609,646 | 9/1952 | Total | 53/230 |
| 2,994,167 | 8/1961 | Chalmers . | |
| 2,999,345 | 9/1961 | Chalmers | 53/230 |
| 3,412,520 | 11/1968 | Schmermund | 53/230 X |
| 3,511,014 | 5/1970 | Kochalski | 53/466 X |
| 3,896,988 | 7/1975 | Mayled | 229/33 |
| 4,183,191 | 1/1980 | Focke | 153/234 X |
| 4,286,712 | 9/1981 | Focke | 206/264 |
| 4,293,068 | 10/1981 | Focke et al. | 206/264 |
| 4,322,931 | 4/1982 | Niepmann | 53/449 |
| 4,351,142 | 9/1982 | Focke et al. | 53/575 |
| 4,586,605 | 5/1986 | Newsome | 206/267 |
| 4,607,748 | 8/1986 | Focke | 206/254 |
| 4,655,030 | 4/1987 | Zeitel et al. | 53/456 |
| 4,708,704 | 11/1987 | Focke et al. | 493/151 |
| 4,753,383 | 6/1988 | Focke et al. | 229/160.1 |
| 4,789,060 | 12/1988 | Focke et al. | 206/274 |
| 4,790,115 | 12/1988 | Focke | 53/234 |
| 4,843,798 | 7/1989 | Focke et al. | 53/453 |
| 4,923,059 | 5/1990 | Evers et al. | 206/265 |

FOREIGN PATENT DOCUMENTS

| | | | |
|---|---|---|---|
| 539604 | 7/1955 | Belgium | 53/230 |
| 187577 | 2/1964 | Sweden | 53/228 |

OTHER PUBLICATIONS

Lamm, Klaus Peter, European Patent Application, Publication No. 0414532A1, published Feb. 27, 1991 Bulletin 91/09.

*Primary Examiner*—John Sipos
*Attorney, Agent, or Firm*—Brenda J. Panichi

[57] ABSTRACT

A method of folding foil around cigarette bundles where the exposed foil on the top of the bundle is flat with no apparent folds. The smooth flat appearance is created by forming the top folds prior to forming the side folds. Notches or holes cut into the foil by which folding stresses on the outermost cigarettes in the bundle are reduced are also provided.

11 Claims, 8 Drawing Sheets

FIG.3
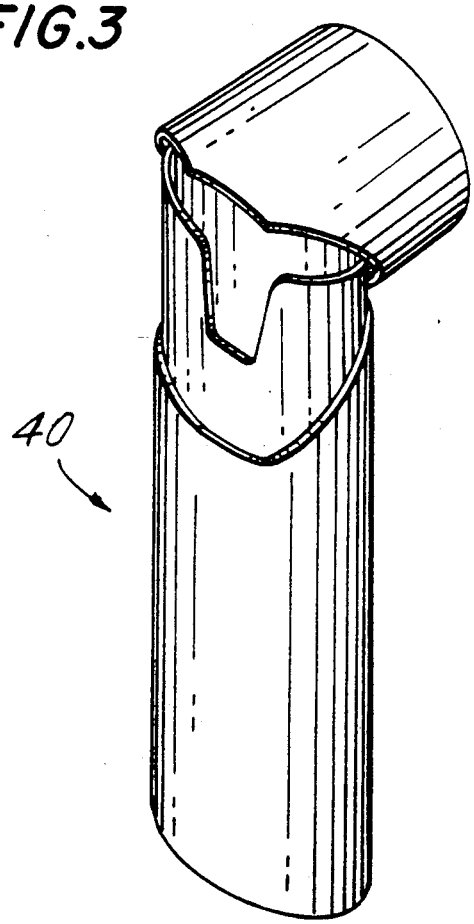
FIG.6
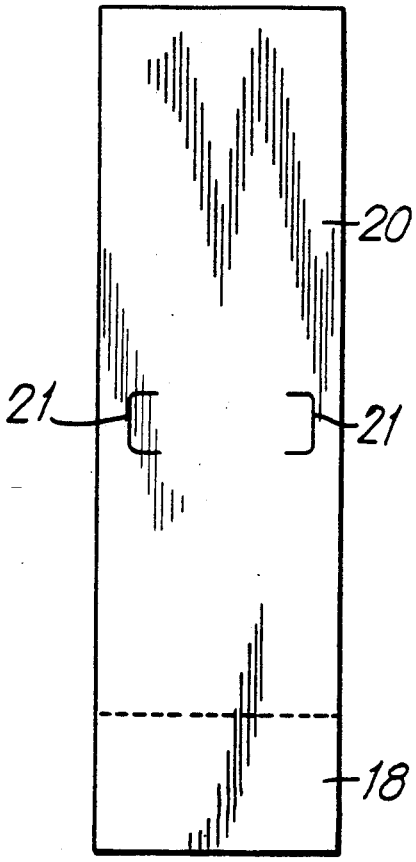
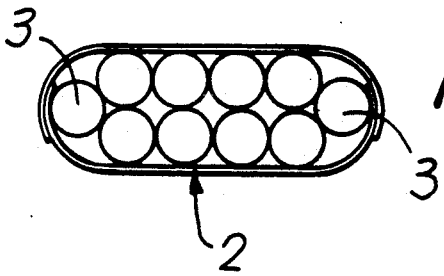
FIG.4
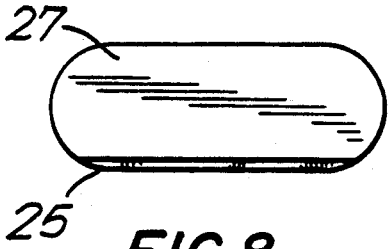
FIG.8
FIG.7
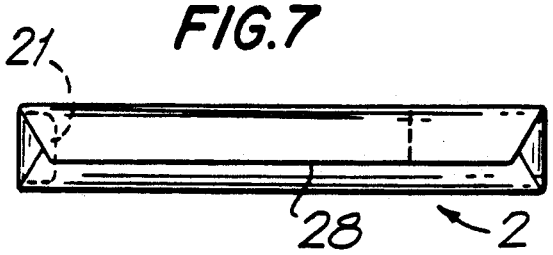

16
19
5
17
3
24
102
22
21
3
2
20
2

METHOD WHERE EXPOSED FOIL ON TOP OF CIGARETTE BUNDLE IS FLAT WITH NO APPARENT FOLDS

BACKGROUND OF THE INVENTION

This invention relates to a method of folding foil or other similar wrapping material around cigarette bundles, and particularly to a method where the exposed foil on the top of a cigarette bundle is flat with no apparent folds.

Cigarettes are typically sold in packs which consist of a bundle of cigarettes wrapped in foil, overwrapped with paper which usually has brand and other information printed on its outer side, and again overwrapped with a sealed polypropylene layer. Two types of packs are in general use. The first type is a soft pack as described above. The second type is a box which is a hard paperboard box having a hinged lid at the top. When either type of pack is opened in order to remove a cigarette, the foil on top of the cigarette bundle is revealed. The configuration of the foil generally has an appearance similar to that of a gift package or envelope. More specifically, the sides of the foil are folded inwardly before the top and bottom folds are made, resulting in the gift package appearance.

When an hinged top box of flattened oval cross section is provided, the foil on the top of the cigarette bundle is better suited to a configuration having no apparent folds rather than the gift package type configuration. This is due to the arrangement of the cigarettes within the box. In a box of flattened oval cross section, it is not desirable to arrange the cigarettes into even-numbered columns. This will leave a void at each side of the box and will cause damage to the cigarettes due to shifting inside the box. Rather, it is necessary to nest one cigarette between the rows at each of the outermost, or "outboard" positions. This configuration best fits the flattened oval shape. However, it may also lead to excessive pressure on the outboard cigarettes from the foil folded around the end of cigarette bundle. Due to the resultant pressure, the outboard cigarettes frequently suffer an undesirable mutilation in their cross sectional areas.

SUMMARY OF THE INVENTION

It is an object of the invention to provide a new method of folding foil around cigarette bundles such that the foil on the top of the bundle appears flat with no apparent folds.

It is another object of the invention to provide a cigarette pack of increased attractiveness to smokers.

It is yet another object of the invention to provide a method of reducing damage to outboard cigarettes from folding pressures.

In accordance with the invention, a method of folding foil around cigarette bundles is provided by which a pair of top folds are made prior to the longitudinal side folds, as is the foil wrapping method in most common use. By making the longitudinal side folds at a later point in the wrapping process, the need to make triangular folds on the top of the bundle from the excess foil remaining after the longitudinal side folds are made is eliminated. Thus the foil on the top of the bundle of cigarettes can be given a smooth appearance with no apparent folds.

Before the cigarettes are wrapped in the foil, small holes or notches may be cut into the foil sheet as a means of reducing folding stresses which can cause damage to the cigarettes. The holes or notches are to be located on the foil at the point where the foil folds around the outboard cigarettes. Most preferably, notches in the shape of a "C" are positioned on the foil.

The above and other objects and advantages of the invention will be apparent from consideration of the following detailed description, taken in conjunction with the accompanying drawings in which like reference characters refer to like parts throughout.

BRIEF DESCRIPTION OF THE DRAWINGS

FIG. 3 is a perspective view of a hinged top box of flattened oval cross section which is preferred for use with the method of the present invention.

FIG. 4 is an end view of the configuration of a bundle of cigarettes contained with a box of flattened oval cross section.

FIG. 7 is a side view of the cigarette bundle illustrating the longitudinal side folds.

FIG. 8 is an end view of the top of the cigarette bundle illustrating the smooth appearance of the foil as seen when the cigarette box is opened.

DETAILED DESCRIPTION OF THE INVENTION

Figure 1:
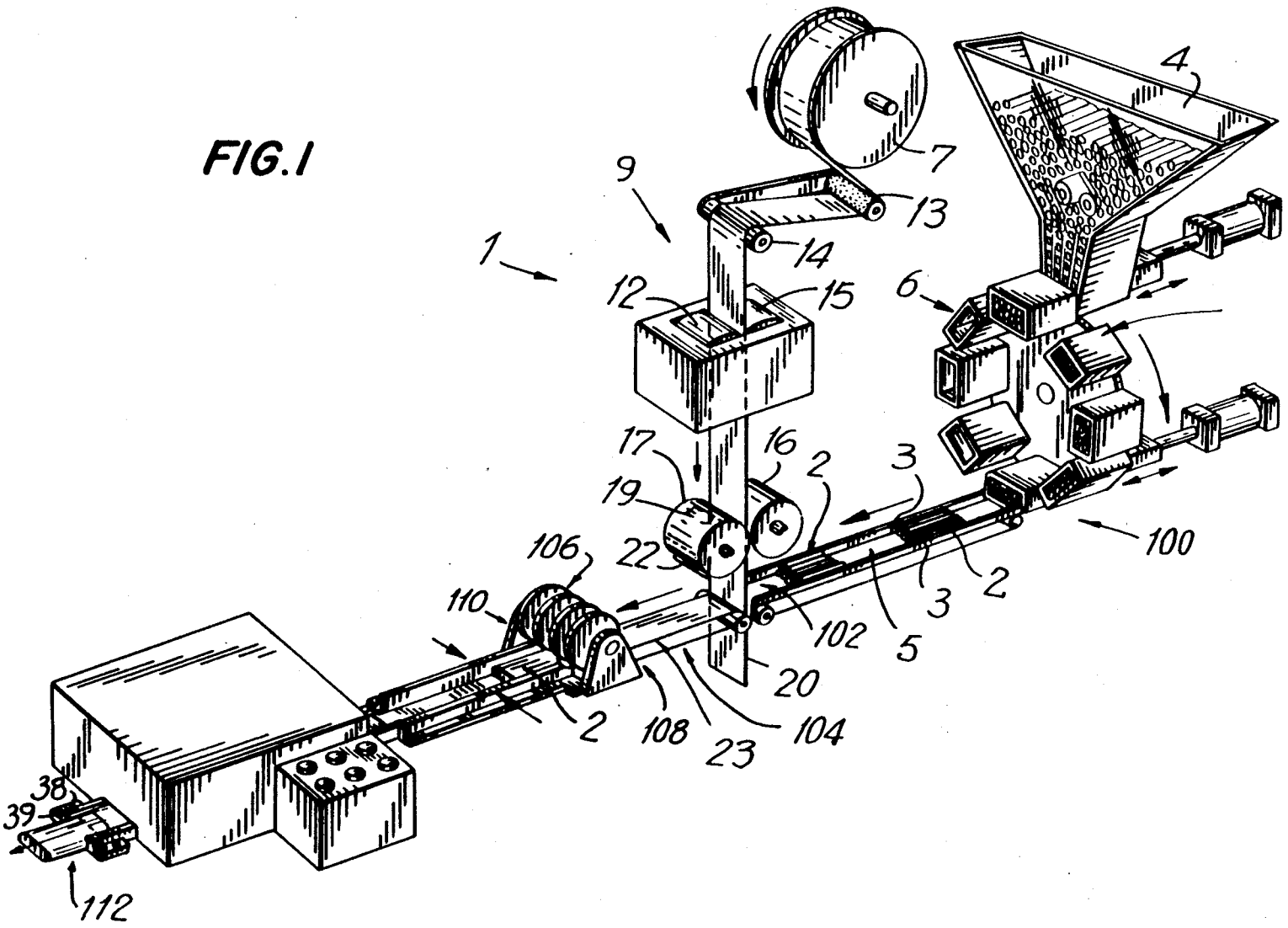
FIG. 1 is a perspective view of a preferred apparatus for carrying out the method of the present invention.

A preferred embodiment of the foil folding method of the present invention will now be described. FIG. 1 is a schematic diagram of a preferred apparatus for carrying out the method of the present invention. Most preferably, the apparatus is a standard Molins filler section which has been modified such that the steps comprising the method of this invention can be performed in the order hereinafter described.

Figure 2:
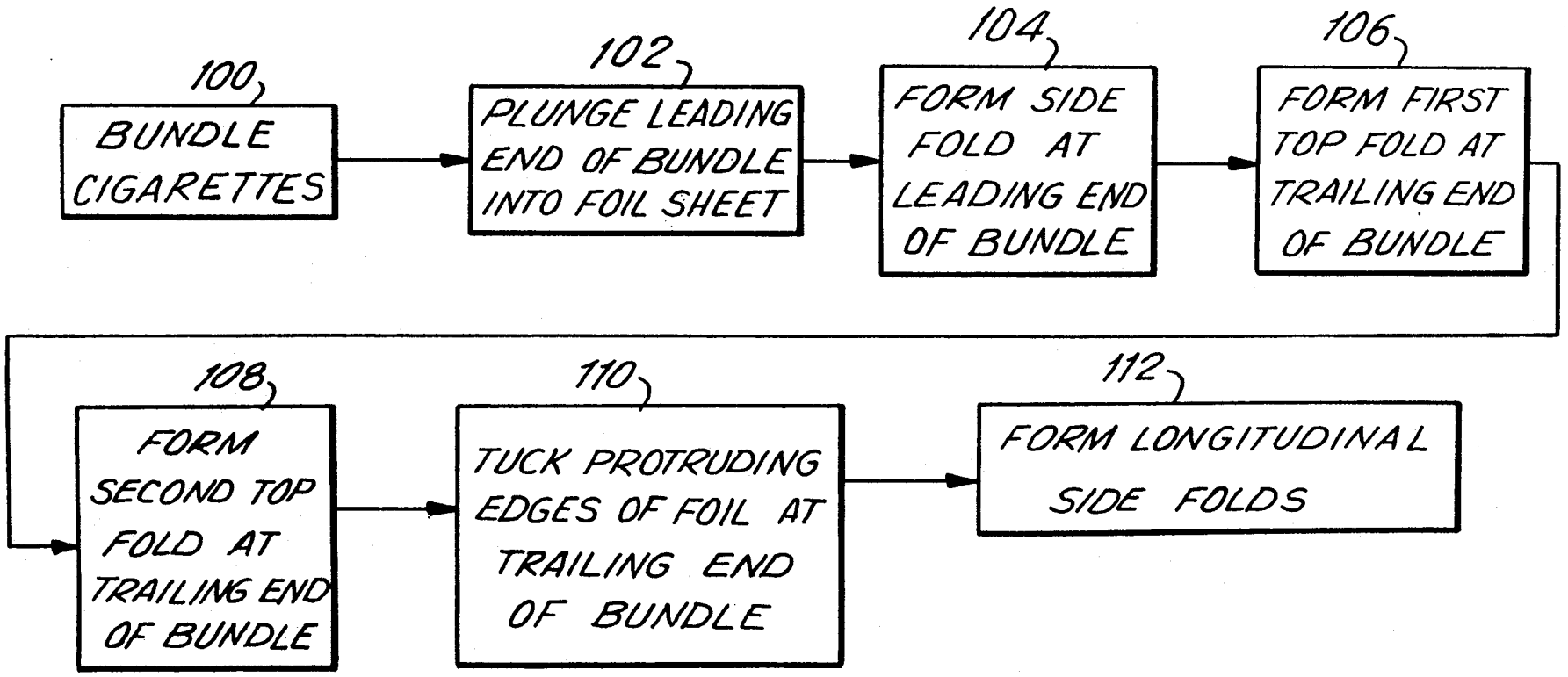
FIG. 2 is a flow chart of the foil folding method in accordance with this invention.

FIG. 2 is a flow chart of the foil folding method of this invention. As can be seen from FIG. 1, the steps described in FIG. 2 are performed successively as the cigarettes move through the various parts of wrapping apparatus 1.

Referring to FIGS. 1 and 2, in step 100 loose cigarettes are bundled into the desired configuration, which is dependent upon the size and shape of the cigarette box. The method of this invention is particularly useful for wrapping a bundle of cigarettes to be placed in a box of flattened oval cross section. FIG. 3 illustrates a preferred construction of box of flattened oval cross section 40 which can readily accommodate a bundle of cigarettes wrapped in accordance with the method of this invention.

A preferred configuration of cigarettes for use in box of flattened oval cross section 40 is shown in FIG. 4. The ten cigarettes are bundled into two rows of four cigarettes per row with two "outboard" cigarettes 3 nested between the rows at the ends of bundle 2.

Referring again to FIG. 1, according to a preferred bundling method, cigarettes are loaded into hopper 4, where they gravitate between vanes for transfer to filler bed 5. From the vanes, the cigarettes are pushed into individual pockets mounted on pocket wheel 6 and rotated through 180 degrees to the filler bed level. Preferably, each pocket mounted on pocket wheel 6 is shaped to receive 10 cigarettes configured as shown in FIG. 4.

After pocket wheel 6 reaches its lowermost position, bundle 2 is pushed out of the pocket onto filler bed 5. Bundle 2 is pushed along filler bed 5 between side guide plates to foil feeding and cutting system 9.

Figure 6B:
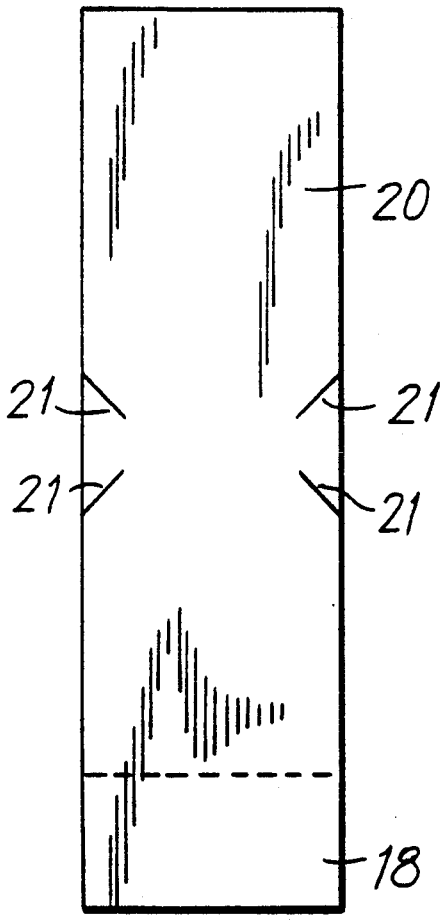
FIGS. 6(*a*)–(*c*) are plan views of different embodiments of the foil sheet of the invention.
Figure 6C:
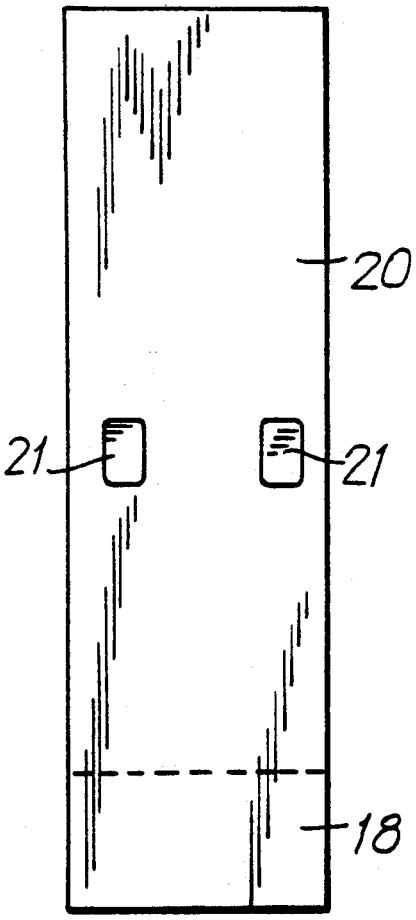

Foil feeding and cutting system 9 is located above filler bed 5. There is also provided a means for serrating the foil to provide foil sheets 20 with a serrated front panel 18 to supersede the standard loose front foil panel. FIG. 6 illustrates foil sheet 20 as formed by foil feeding and cutting system 9.

As shown in FIG. 1, foil feeding and cutting system 9 consists of a series of rollers, including pressure roller 13, pulling roller 14, date code roller 15, embossing roller 12, anvil roller 16 and knife roller 17. The foil is pulled from spool 7 and loaded first through pressure roller 13 and pulling roller 14. Pressure roller 13, which is preferably formed from rubber, maintains tension in the foil and is spring loaded against geared pulling roller 14 which drives the foil through the system 9.

The foil is then loaded through embossing roller 12 and date code roller 15. Embossing roller 12 is etched with the desired foil pattern. Date code roller 15 is provided with the date of production and other factory codes.

Figure 5:
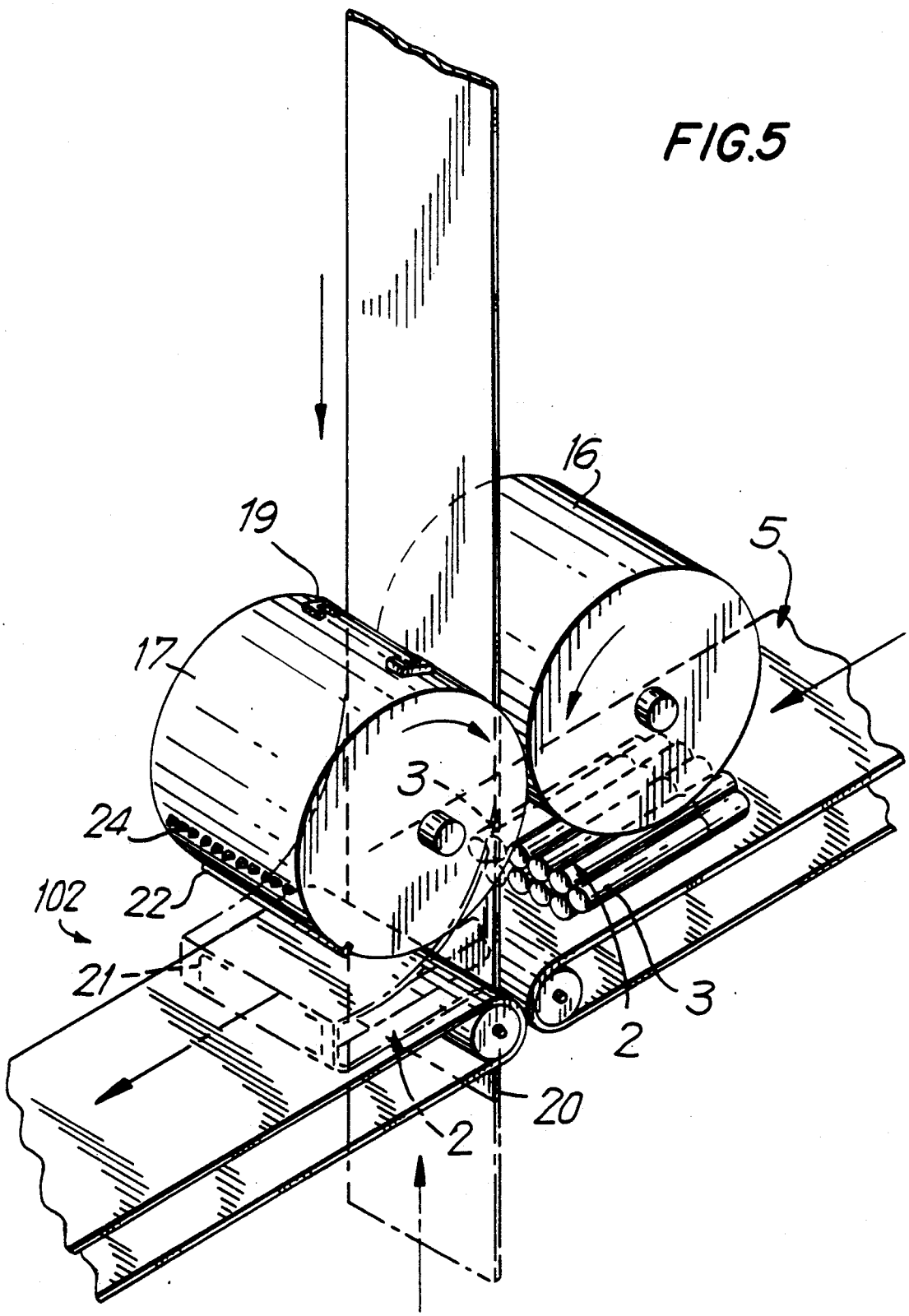
FIG. 5 is a schematic view of the foil cutting apparatus of the invention.

As shown more clearly in FIG. 5, after passing around embossing roller 12 and date code roller 15, the path of the foil is directed downward, where it is passed between knife roller 17 and anvil roller 16. Knife roller 17 contains 2 knives, cut-off knife 22 which cuts the foil to the desired length as the foil passes between knife roller 17 and anvil roller 16, and perforating knife 24 which pierces the foil to provide serrated front panel 18. Anvil roller 16 provides counterpressure so that cutting is facilitated.

Knife roller 17 may also be provided with a pair of knife-like protrusions 19 capable of cutting a notch or a hole in the foil. As mentioned earlier, it is desirable to cut a notch or hole into the foil such that folding stress on the outboard cigarettes is minimized. Preferably, each protrusion 19 is shaped in the form of a "C" as shown in FIG. 5 and forms a pair of notches in the foil. Protrusions 19 are located on knife roller 17 such that they make notches or holes 21 in foil sheet 20 at a location which is approximately at the midpoint of the length of foil sheet 20. FIGS. 6(*a*)–(*c*) illustrate the location of shaped notches or holes 21. FIGS. 6(*a*)–(*c*) also illustrate different embodiments for the notches or holes 21, each of which is more fully described hereinafter.

The most preferable method of reducing folding stress is shown in FIG. 6(*a*). A pair of notches, each notch substantially in the shape of a "C", is cut into the foil.

Another method of reducing the stress on outboard cigarettes 3 is illustrated in FIG. 6(*b*). Four notches are cut inwardly from the edge of foil sheet 20.

Alternatively, the stress on outboard cigarettes 3 can be reduced by cutting a pair of small holes into foil sheet 20, as shown in FIG. 6(*c*). However, problems relating to disposal of the excess foil cut out of sheet 20 make this a less attractive solution.

It is understood that various other embodiments of the foil sheet containing notches or holes may be provided without departing from the scope of this invention.

When cigarette bundle 2 is wrapped in foil sheet 20, notches or holes 21 are located at the end of bundle 2 which is placed into the bottom of the hinged cigarette box. Thus, the unfiltered ends of the cigarettes are nearest notches or holes 21 when the box is constructed. FIG. 7 illustrates the configuration of foil wrapped bundle 2 with notches or holes 21 at the end of bundle 2.

It has been found that when a bundle of flattened oval cross section such as is pictured in FIG. 4 is provided, the folded foil produces excessive stress on outboard cigarettes 3. This stress leads to undesirable mutilation of the ends of outboard cigarettes 3. By cutting notches or holes 21 into foil sheet 20 at the location of the unfiltered ends of outboard cigarettes 3, the stress is reduced because outboard cigarette 3 is then free to occupy a greater area. Thus, the circular cross section of each outboard cigarette 3 is maintained.

After passing between knife roller 17 and anvil roller 16, foil sheet 20 is prepared to begin the wrapping process. In step 102 of FIG. 2, which is more clearly illustrated in FIG. 5, the leading end of the moving cigarette bundle 2 is plunged into foil sheet 20, which leaves the foil feeding and cutting system in a direction perpendicular to the path of travel of bundle 2. The leading end of bundle 2 strikes foil sheet 20 at the point where notches or holes 21 are located. The movement of bundle 2 along filler bed 5 causes foil sheet 20 to become enveloped around bundle 2.

Figure 9:
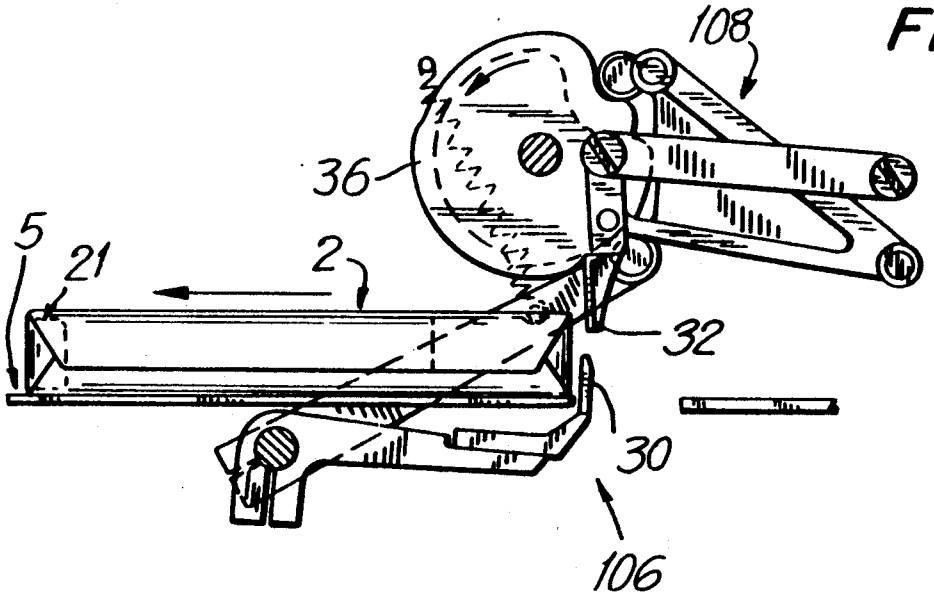
FIG. 9 is a side view of the top folding apparatus.

After foil sheet 20 has been enveloped about bundle 2, there remains an extra length of foil at the trailing edge of the foil which extends beyond the ends of the cigarettes. This extra length will subsequently be formed into first top fold 25 and second top fold 27. FIG. 8 shows the appearance of first top fold 25 and second top fold 27, while FIG. 9 shows the apparatus for forming these folds.

Next, in step 104 of FIGS. 1 and 2, the sides of foil sheet 20 at the leading end of bundle 2 are tucked inward. Fixed side folders 23 are located along the edges of filler bed 5. As bundle 2 is conveyed along filler bed 5, it passes between fixed side folders 23. Fixed side folders 23 tuck the foil in against bundle 2 at the leading end of bundle 2.

As bundle 2 travels further along filler bed 5, the next sequence of foil folds is made to the trailing end of bundle 2. This is the top end of bundle 2 and is the end which is seen by a user of the cigarette box when the box is opened. By utilizing the process of the present invention, the top of cigarette bundle 2 is provided with a smooth, flat appearance with no apparent folds, as shown in FIG. 8.

In order to provide the smooth flat appearance, first top fold 25 and second top fold 27 are made prior to tucking the sides of the foil at the trailing end of bundle 2 in against bundle 2. First top fold 25 and second top fold 27 are also made prior to making longitudinal side folds 28 pictured in FIG. 7.

According to step 106 of FIG. 2 and more clearly shown in FIG. 9, after bundle 2 has travelled down filler bed 5 past foil feeding and cutting assembly 9, first top folder 30 raises up from behind bundle 2 in a direction perpendicular to the direction of travel of bundle 2. First top folder 30 forms first top fold 25 (the "under" flap as shown in FIG. 8) by contacting the foil and pressing it against the filtered ends of the cigarettes which are contained in bundle 2.

Then, in step 108 of FIG. 2, second top folder 32 lowers down from behind bundle 2 in a direction perpendicular to the direction of travel of bundle 2. Second top folder 32 forms second top fold 27 (the "over" flap as shown in FIG. 8) by contacting the foil and pressing it against the filtered ends of the cigarettes which are contained in bundle 2.

Second top folder 32 remains in place until the edges of the foil which protrude laterally from the trailing end of bundle 2 can be tucked in against the bundle.

By tucking the laterally protruding pieces of foil at the trailing end, or top, of the cigarette bundle after forming the first and second top folds at the top of the bundle, the gift package or envelope appearance can be avoided and the foil which is exposed when the pack of cigarettes is opened is provided with the flat, smooth appearance of FIG. 8.

Figure 10:
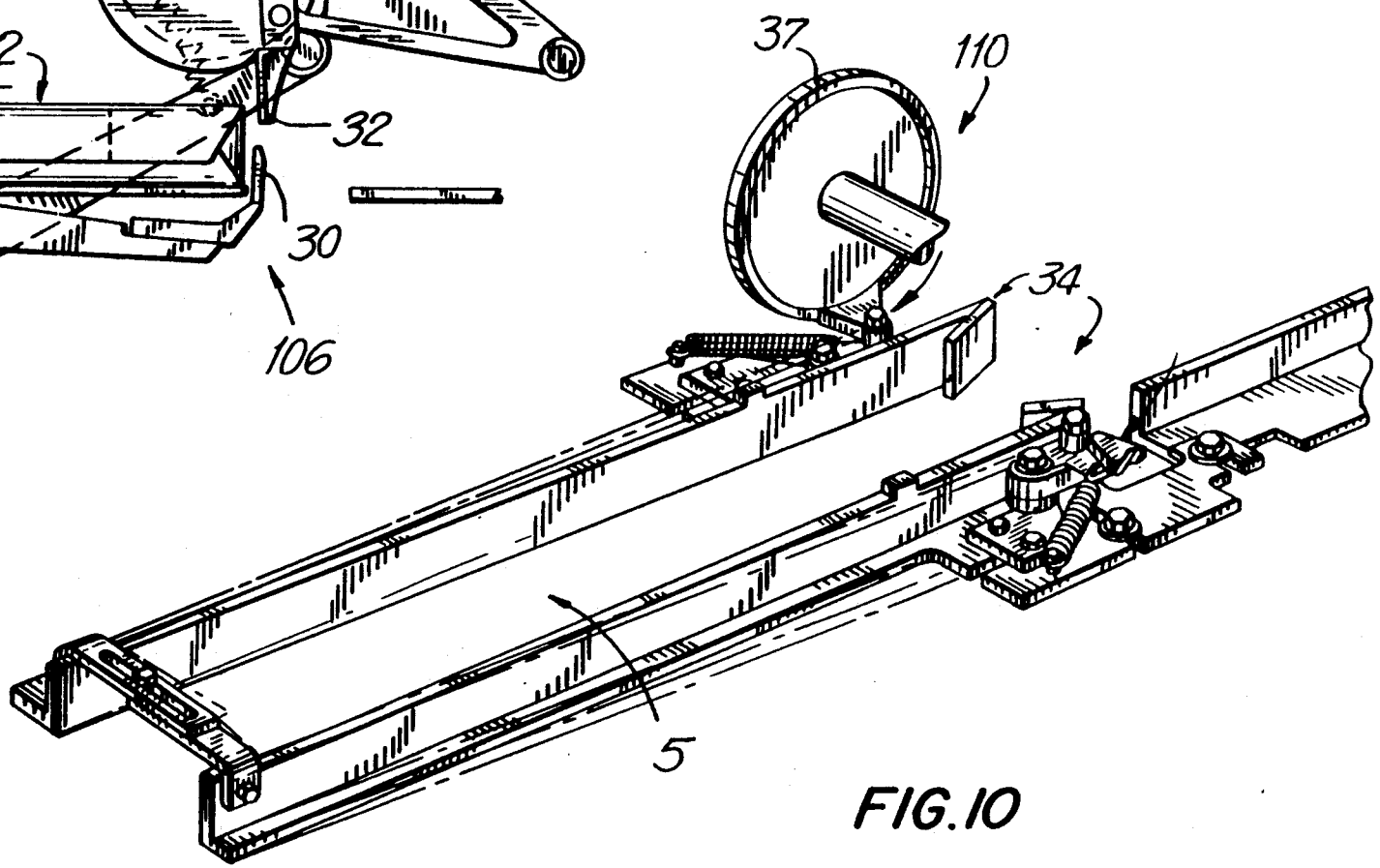
FIG. 10 is a perspective view of the swinging tuckers.

To fold the laterally protruding pieces of foil at the top of the bundle, step 110 of FIG. 2, swinging tuckers 34 are provided, as illustrated in FIG. 10. After first top fold 25 and second top fold 27 have been made, swinging tuckers 34 pivot inwardly and contact the protruding edges of the foil at the top of bundle 2. Second top tucker 32 then retracts as the next bundle arrives to push the first bundle down filler bed 5.

The timing of the folding sequence of steps 106, 108 and 110 must be assured in order to properly form the wrapped bundle. As shown in FIG. 1 and more clearly shown in FIGS. 9 and 10, the first top folding step, the second top folding step and the tucking step are performed while the bundle remains in one position on filler bed 5. The correct timing can easily be provided by use of, for example, first cam assembly 36 for the first top fold and second cam assembly 37 for the swinging tuckers.

Figure 11:
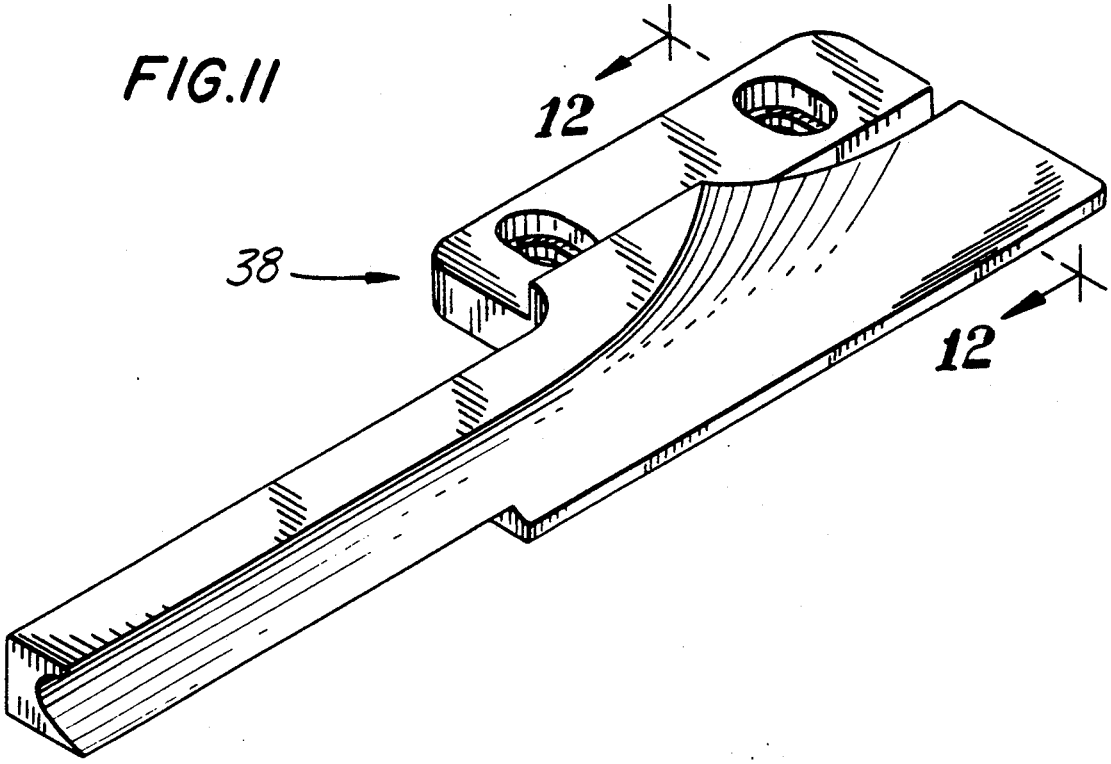
FIG. 11 is a view of the upper plow folder located on the right side of the apparatus.
Figure 12:
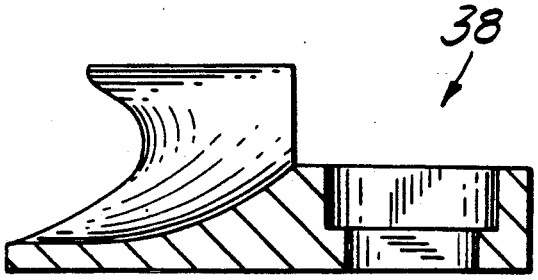
FIG. 12 is a sectional view of the upper plow folder shown in FIG. 11.
Figure 13:
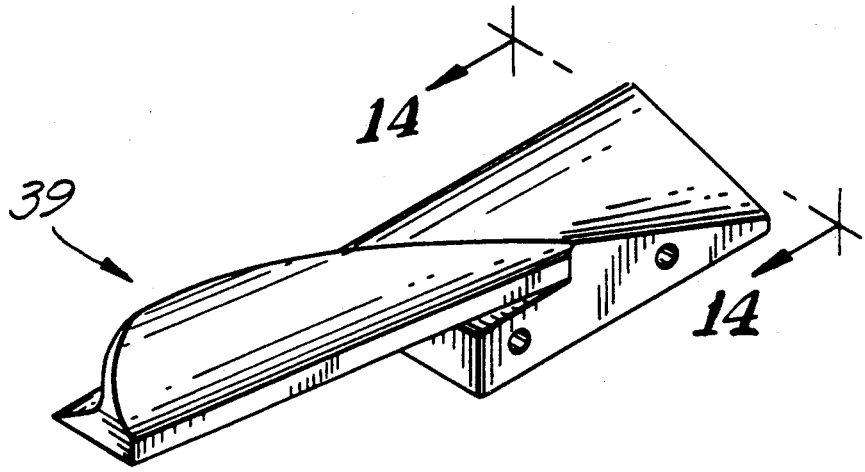
FIG. 13 is a view of the lower plow folder located on the right side of the apparatus.
Figure 14:
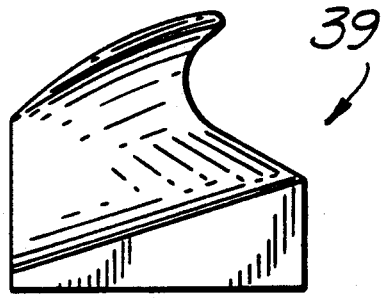
FIG. 14 is a sectional view of the lower plow folder shown in FIG. 13.

Finally, in step 112 of FIG. 2, longitudinal side folds 28 are formed. FIGS. 11-14 illustrate a pair of stationary plow folders 38, 39 which are provided to form longitudinal side folds 28. FIGS. 11 and 12 are views of upper plow folder 38 located on the right hand side of filler bed 5, while FIGS. 13 and 14 are views of lower plow folder 39 located on the right side of filler bed 5. The upper and lower plow folders located at the opposite side of filler bed 5 are not pictured but are mirror images of those shown in FIGS. 11-14.

After all of the folds at the trailing end of bundle 2 have been formed, bundle 2 travels a distance down filler bed 5, where it moves between plow folders 38 and 39 such that upper plow folder 38 contacts the upper surface of bundle 2 and lower plow folder 39 contacts the lower surface of bundle 2. The curved shape of plow folders 38 and 39 causes the foil to become substantially molded to the rounded shape of bundle 2.

It can be seen from FIGS. 11 and 13 that the surface of lower plow folder 39 is shorter than that of upper plow folder 38. Thus, as bundle 2 moves along filler bed 5, it first comes into contact with lower plow folder 38. Longitudinal folding begins at the lower side of bundle 2 so that the foil at the upper side can be pressed down on top of the foil on the lower side, as shown in FIG. 7.

After all the folds have been made, the wrapped bundle continues to move along filler bed 5 until it reaches the end of filler bed 5. There the wrapped bundle is fitted inside box 40 which has previously been formed by a separate apparatus.

We claim:

1. An apparatus for folding wrapping material around a bundle of cigarettes where the exposed wrapping material on the top of the bundle is flat with no apparent folds, comprising:

means for bundling a plurality of cigarettes, such that the bundle comprises two rows of cigarettes with two outboard cigarettes nested between the rows at the ends of the rows and having a leading end and a trailing end;

means for transporting the bundle through the apparatus;

means for supplying a length of wrapping material in which the bundle is wrapped;

a pair of side folders for tucking the wrapping material at the outermost parts of the leading end of the bundle inward;

a first top folder for forming a first top fold against the exterior surface of the trailing end of the bundle such that the first top fold is located at an upstanding end of the bundle when the bundle is placed in a cigarette box;

a second top folder for forming a second top fold against the exterior surface of the trailing end of the bundle such that the second top fold substantially covers the first top fold and is visible when the bundle is placed in a cigarette box in an upstanding position;

a pair of tuckers for pressing the outermost parts of the wrapping material at the trailing end of the bundle after the first top fold and the second top fold have been formed flat against the longitudinal sides of the bundle "hereby the exposed wrapping material on the top of the bundle is flat with no apparent folds; and a pair of longitudinal side folders for pressing the wrapping material along the axial sides of the bundle, each side folder having the arcuate shape of a cigarette for pressing the wrapping material along the outboard cigarettes, the arcuate shape adapted to receive the bundle.

2. The apparatus as defined in claim 1 wherein the means for supplying the length of wrapping material is comprised of a spool from which the length of wrapping material is drawn;

a plurality of rollers whereby a proper amount of tension is maintained in the length of wrapping material; and a knife roller having a cutting edge extending the length of the knife roller.

3. The apparatus as defined in claim 2 further comprising means for cutting at least one notch into the length of wrapping material at approximately the mid-length of the wrapping material.

4. The apparatus as defined in claim 2 further comprising means for cutting at least one hole into the length of wrapping material at approximately the mid-length of the wrapping material.

5. The apparatus as defined in claim 3 wherein each of the notches is substantially in the shape of a C.

6. The apparatus as defined in claim 3 wherein each of the notches is cut inwardly from an exterior edge of the wrapping material.

7. The apparatus as defined in claim 1 wherein the means for transporting the bundle transports the bundle along a substantially linear path.

8. The apparatus as defined in claim 1 wherein the cigarette box has the shape of a flattened oval.

9. The apparatus as defined in claim 7 further comprising guide plates wherein the bundle travels between the guide plates.

10. The apparatus as defined in claim 1 further comprising guide plates having a shape to receive the outboard cigarettes as the bundle travels between the guide plates.

11. An apparatus for folding wrapping material around a bundle where the exposed wrapping material on top of the bundle is flat with no apparent folds, comprising:

means for bundling a plurality of cigarettes, such that the bundle is comprised of two rows of cigarettes with two outboard cigarettes nested between the rows at the ends of the rows and having a leading end and a trailing end;

means for transporting the bundle through the apparatus;

means for supplying a length of wrapping material in which the bundle is wrapped;

a pair of side folders for tucking the wrapping material at the outermost parts of the leading end of the bundle inward;

a first top folder for forming a first top fold against the exterior surface of the trailing end of the bundle such that the first top fold is located at an upstanding end of the bundle when the bundle is placed in a cigarette box;

a second top folder for forming a second top fold against the exterior surface of the trailing end of the bundle such that the second top fold substantially covers the first top fold and is visible when the bundle is placed in a cigarette box in an upstanding position;

a pair of tuckers for pressing the outermost parts of the wrapping material at the trailing end of the bundle after the first top fold and the second top fold have been formed flat against the longitudinal sides of the bundle; and a pair of longitudinal side folders for pressing the wrapping material along the axial sides of the bundle, each side folder having the arcuate shape of a cigarette for pressing the wrapping material along the outboard cigarettes, the arcuate shape adapted to receive the bundle.

* * * * *